US009289074B1

(12) United States Patent
Corbin et al.

(10) Patent No.: US 9,289,074 B1
(45) Date of Patent: Mar. 22, 2016

(54) SLEEPING SYSTEM AND METHOD FOR ADJUSTING THE SAME

(76) Inventors: David R. Corbin, Nashville, TN (US); Stephen S. Russo, Nashville, TN (US)

( * ) Notice: Subject to any disclaimer, the term of this patent is extended or adjusted under 35 U.S.C. 154(b) by 786 days.

(21) Appl. No.: 13/090,331

(22) Filed: Apr. 20, 2011

(51) Int. Cl.
*A47C 27/15* (2006.01)
*A47C 27/14* (2006.01)

(52) U.S. Cl.
CPC ..... *A47C 27/148* (2013.01); *A47C 27/15* (2013.01)

(58) Field of Classification Search
CPC ..... A47C 27/14; A47C 27/148; A47C 27/15
USPC ..... 5/722, 727, 738, 740, 691, 249
See application file for complete search history.

(56) References Cited

U.S. PATENT DOCUMENTS 2,651,788 A * 9/1953 Forwood ..... 5/716
3,521,311 A * 7/1970 Cohen ..... 5/727
3,534,417 A 10/1970 Boyles
3,626,523 A * 12/1971 Robins ..... 5/716
4,040,133 A 8/1977 Gilreath
4,213,214 A 7/1980 Gilhooly
4,458,371 A 7/1984 Whitehead
4,554,692 A 11/1985 Whitehead
4,771,995 A 9/1988 Wells et al.
4,862,541 A 9/1989 Hutton et al.
4,916,766 A 4/1990 Grandy
5,161,276 A 11/1992 Hutton et al.
5,182,827 A 2/1993 Carrier et al.
5,259,079 A 11/1993 Visser et al.
5,471,688 A * 12/1995 Cavazos ..... 5/251
5,513,402 A * 5/1996 Schwartz ..... 5/691
5,642,547 A 7/1997 Hutton et al.
5,745,940 A 5/1998 Roberts et al.
5,794,285 A 8/1998 Burch
5,819,340 A 10/1998 Kelly
5,819,349 A 10/1998 Schwartz
5,960,496 A * 10/1999 Boyd ..... 5/722
5,970,547 A * 10/1999 Cavazos ..... 5/690
6,101,653 A 8/2000 England
6,298,510 B1 10/2001 Mossbeck
6,481,033 B2 11/2002 Fogel
6,684,425 B2 2/2004 Davis
6,687,935 B2 2/2004 Reeder et al.
6,721,982 B2 4/2004 Freeman
7,047,579 B2 5/2006 Piana et al.
7,104,593 B2 9/2006 Hungerford et al.
7,155,765 B2 * 1/2007 Fogg ..... 5/691
7,191,483 B2 * 3/2007 Hochschild ..... 5/740
7,353,550 B2 4/2008 Antinori
7,386,903 B2 6/2008 Hochschild (Continued)

OTHER PUBLICATIONS

"Unity—Half Soft and Half Firm Mattress by Essentia", Essentia, Quebec, Canada—http://www.myessentia.com/product-info.php?unity-pid8.html; Feb. 24, 2011.

*Primary Examiner* — Michael Trettel
(74) *Attorney, Agent, or Firm* — W. Edward Ramage; Baker Donelson

(57) ABSTRACT

The present invention discloses a sleeping system capable of customization so that at least six different levels of firmness may be achieved per bed. The present invention discloses three layers which may be positioned by the end user in order to achieve the desired firmness. The present invention also includes a method of selling such interchangeable modular bedding. In the method, after selling the bedding, at least one of the three layers may be exchanged in order to achieve yet another alternate firmness level.

17 Claims, 2 Drawing Sheets

(56) References Cited

U.S. PATENT DOCUMENTS

| | | | | |
|---|---|---|---|---|
| 7,454,810 | B2 | 11/2008 | Wells | |
| 7,607,181 | B1 | 10/2009 | Harrison | |
| 7,661,166 | B1 | 2/2010 | Marling et al. | |
| 7,748,066 | B2 | 7/2010 | Gladney | |
| 7,827,633 | B2 | 11/2010 | Taylor | |
| 7,930,780 | B2 | 4/2011 | Clenet | |
| 8,117,700 | B2 * | 2/2012 | Howard | 5/690 |
| 2002/0062524 | A1 | 5/2002 | Vogland et al. | |
| 2003/0135930 | A1 | 7/2003 | Varese et al. | |
| 2003/0140422 | A1 | 7/2003 | Sama | |
| 2005/0028273 | A1 | 2/2005 | Weedling et al. | |
| 2007/0283501 | A1 | 12/2007 | Mossbeck | |
| 2008/0134431 | A1 | 6/2008 | Piana | |
| 2008/0201856 | A1 | 8/2008 | Howard | |
| 2010/0115697 | A1 | 5/2010 | Rohr | |
| 2010/0229309 | A1 | 9/2010 | Goldsmith | |
| 2012/0017370 | A1 | 1/2012 | Lee et al. | |
| 2013/0174348 | A1 * | 7/2013 | Stowe | 5/720 |

* cited by examiner

SLEEPING SYSTEM AND METHOD FOR ADJUSTING THE SAME

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

There are a variety of reasons that would lead a person to want to alter the firmness of his or her bed. When a person experiences a change in condition such that an alternate bed firmness is desired, conventional beds offer no opportunity for such a change. Conventional beds include a box spring with a mattress on top. As is generally known, mattresses are available for purchase in a variety of firmness levels. Accordingly, a purchaser may select a bed which is appropriate at that point in time. Unfortunately, as the bed ages and as the user experiences life changes, the comfort and firmness of the bed may not meet the needs of the user. Generally, the process of selecting a conventional bed consists of briefly lying on a display bed in a retail store. Such brevity in a retail setting is likely not sufficient to properly identify the desired bed firmness. Further, when a consumer buys a conventional bed, it is then his or hers, without an opportunity for exchange or upgrade. It is well know that conventional beds do not provide for adjustment of the bed's firmness. So, as the bed ages or the user desires a change the only available option is to purchase a whole new bed.

SUMMARY OF INVENTION

Disclosed herein is a sleeping system that provides at least six different firmness levels per bed, which may adjusted by an end user. As further described herein, the present invention may be reconfigured in a variety of ways in order to provide a user the convenience of an altered firmness level with little effort. Also disclosed herein is a method of selling the sleeping system by using minimal retail floor space. Also disclosed is a method of exchanging the comfort layer of the sleeping system after it has been sold in order to provide the user with further alternate firmness levels. That is, the invention disclosed herein provides the benefit of a single sleeping system having modular components so that, after it is sold, the comfort layer may be easily exchanged for a new or alternate comfort layer which is compatible with the sleeping system. The sleeping system includes a comfort layer, support layer, and foundation layer. For each layer, different types of technology, such as latex or foam, may be chosen to customize the resulting sleep experience. As further described below, either side of the comfort layer may be used as a sleeping surface. Also, the surface of the support layer may be used as a sleeping surface. Also disclosed herein is a method of offering different price points for the variety of sleeping systems that are available.

Disclosed herein is a sleeping system, including, a comfort layer, a support layer positioned beneath the comfort layer, a foundation layer positioned beneath the support layer, wherein the comfort layer has a plurality of firmness sections, and wherein the support layer has a sleeping surface. In certain embodiments of the invention, the comfort layer has a first side and a second side, the first side of the comfort layer has a sleeping surface and the second side of the comfort layer has a sleeping surface. In yet other embodiments, the foundation layer has a plurality of firmness sections. In certain embodiments, the system has an original firmness level and rotation of the comfort layer by 180 degrees results in a secondary firmness level.

In still other embodiments, disclosed herein is a bedding system, including, a support layer, the support layer having a sleeping surface, a foundation layer positioned beneath the support layer, wherein the foundation layer has a first firmness section and a second firmness section, so that the bedding system has a plurality of firmness levels. In certain embodiments, the first firmness section of the foundation layer is more firm than the second firmness section of the foundation layer. In other embodiments, the portion of the system having the first firmness section of the foundation layer has the first of the plurality of the firmness levels. In yet other embodiments, the portion of the system having the second firmness section of the foundation layer has the second of the plurality of the firmness levels. In yet other embodiments, the system further includes a comfort layer positioned on top of the support layer, the comfort layer having a first side and a second side, wherein the comfort layer is customizable to a desired firmness. In still other embodiments of the invention, the first side of the comfort layer is a sleeping surface and the second side of the comfort layer is a sleeping surface. In certain embodiments, the comfort layer is rotatable or flippable. In other embodiments, the comfort layer has a first firmness section and a second firmness section. In certain embodiments, the first firmness section of the comfort layer is more firm than the second firmness section of the comfort layer. In other embodiments, the portion of the system having the orientation of the first firmness section of the comfort layer above the first firmness section of the foundation layer has the third of the plurality of the firmness levels. In yet other embodiments, the portion of the system having the orientation of the second firmness section of the comfort layer above the first firmness section of the foundation layer has the fourth of the plurality of the firmness levels. In other embodiments, the portion of the system having the orientation of the first firmness section of the comfort layer above the second firmness section of the foundation layer has the fifth of the plurality of the firmness levels. In still other embodiments, the portion of the system having the orientation of the second firmness section of the comfort layer above the second firmness section of the foundation layer has the sixth of the plurality of the firmness levels.

Disclosed herein is a method of selling interchangeable modular bedding, including, providing interchangeable modular bedding, the interchangeable modular bedding further including a comfort layer, a support layer, and a foundation layer, displaying for sale the interchangeable modular bedding in a reduced floor space due to the lack of a need for display of multiple beds, providing a plurality of different foundation layers and comfort layers at a plurality of price points, configuring the interchangeable modular bedding to the firmness desire of a consumer so that the consumer may test the bedding, determining a price point to apply to the consumer, selling the bedding, and exchanging the comfort layer after selling the interchangeable modular bedding so that the consumer may experience an alternate firmness level. In yet other embodiments, two beds are displayed so that at least twelve different firmness levels are available for consideration by the consumer.

Accordingly, one object of the present invention is to provide a sleeping system which is adjustable to the needs of the user.

Another object of the present invention is to provide a sleeping system that is easily reconfigured to alter the firmness level provided.

Still another object of the present invention is to provide a method of selling bedding which minimizes the amount of retail floor space required for display units.

Yet another object of the present invention is to provide a method of offering different price points to consumers for bedding.

Still another object of the present invention is to provide a method of exchanging components of a modular bedding system such that replacement of the entire system is not required.

BRIEF DESCRIPTION OF THE DRAWINGS

In FIGS. 5A and 5B, the comfort layer has been removed so that the sleeping surface of the support layer is exposed. Such reconfiguration results in firmness levels one and two.

DESCRIPTION OF THE PREFERRED EMBODIMENTS

Figure 1:
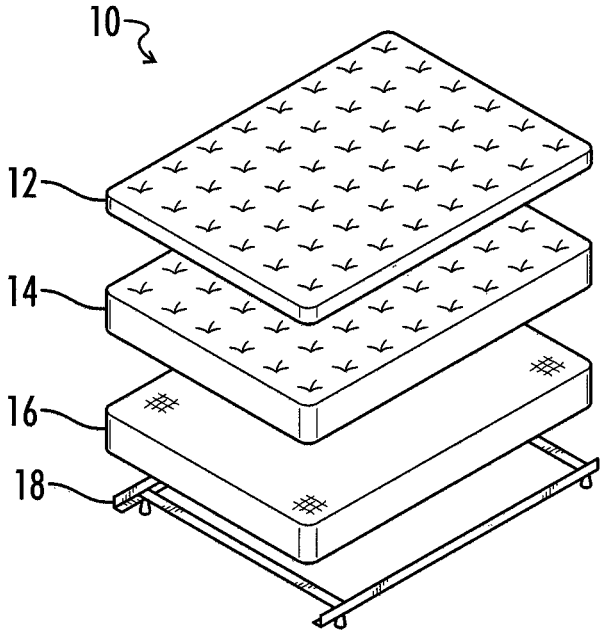
FIG. 1 is an isometric view of an embodiment of the sleeping system disclosed herein. Shown therein is the comfort layer, support layer, foundation layer, and a bed frame. Also shown therein are the sleeping surfaces of the comfort layer and support layer.

The present invention is a sleeping system that is easily adjustable to different levels of firmness. The sleeping system, referred to as the system 10, includes a comfort layer 12, support layer 14, and a foundation layer 16. A retailer, wholesaler, or end user may position or reconfigure the three layers in order to customize the sleeping surface. Specifically, the comfort layer 12 is sized for easy rotation, flipping, or removal, as desired. The resulting adjustments to the firmness of the system 10 are further discussed below. Further, the present invention includes a method of selling the system 10 in which only minimal floor space is required for display. Further, the methods disclosed herein allow for selling the systems 10 at various price points depending upon the desire of the consumer. Finally, the methods disclosed herein allow for the exchange, or replacement, of the comfort layer 12 of the system 10 after the system 10 has been sold so that the end user may experience yet an alternate level of firmness.

Referring now to FIG. 1, there is shown an isometric view of the system 10 including a comfort layer 12 positioned on top of a support layer 14, which is positioned on top of a foundation layer 16. In certain embodiments the system 10 may be positioned on a bed frame 18, or other mount, as known to those of ordinary skill in the art. Customization of the system 10 is accomplished by rotating, flipping, or removing the comfort layer 12. Further customization is accomplished by rotation of the foundation layer 16. In certain embodiments of the present invention, the comfort layer 12 and the foundation layer 16 each have multiple firmness sections therein. The line of delineation between the two firmness sections may be along the longitudinal middle of each layer, as best seen in FIGS. 2-5B. In alternate embodiments, the boundary of such firmness sections may be according to the needs of a user, as further described in the next paragraph. By orienting or configuring the firmness sections of the comfort layer 12 and foundation layer 16, the retailer or end user is altering the firmness of each sleeping position of the system 10. While the figures represent systems 10 sufficient for sleeping two people, in other embodiments, the system 10 may be constructed for a single person.

Figure 2:
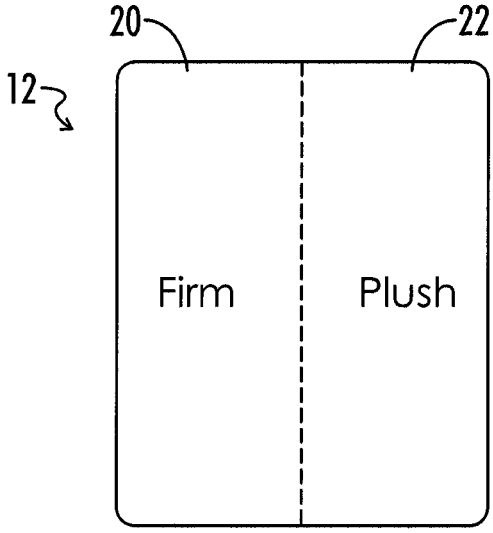
FIG. 2 is a top view of an embodiment of the comfort layer disclosed herein. The broken line depicts the boundary of the different firmness sections within the comfort layer, and is not actually visible but rather is provided as part of the schematic drawing.

Referring now to FIG. 2, there is shown a top view of a comfort layer 12. Shown therein is the first firmness section 20 and second firmness section 22 of the comfort layer 12. The broken line therein is a schematic delineation of the boundaries of the two firmness sections. In the embodiment shown, the first firmness section 20 is firm and the second firmness section 22 is plush, or soft. In alternate embodiments of the comfort layer 12, or the foundation layer 16, the boundaries of the firmness sections may change depending upon the needs of the end user. For example, in certain embodiments, firmness sections may have horizontal boundaries, rather than longitudinal boundaries, in order to create comfort zones for better posture. By way of example, a comfort layer 12 or a foundation layer 16 may have different firmness sections corresponding to different areas of the body, such as the torso or legs. By way of another example, a comfort layer 12, or a foundation layer 16, may have a section therein which is firm and another section therein which is plush, soft or less firm. As further described herein, the comfort layer 12 may be rotated for firmness and flipped for longevity.

Figure 3:
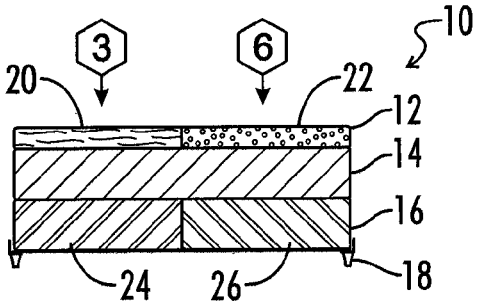
FIG. 3 is a schematic drawing of a cross-sectional view of an embodiment of the sleeping system disclosed herein. The cross-section is along the 3-3 line shown in FIG. 7. Shown in FIG. 3 is a comfort layer having two firmness sections which are constructed of two different materials, a support layer having a single material of construction, and a foundation layer having two firmness sections which are constructed of different material. As further shown in FIGS. 4, 5A and 5B, reconfiguration of the layers results in the sleeping system having different firmness levels. Firmness levels are noted in the hexagon shapes. The lower the number, the more firm the firmness level. Accordingly, firmness level one is the most firm and firmness level six is the most plush. Shown in this Figure is a configuration resulting in firmness levels three and six.
Figure 4:
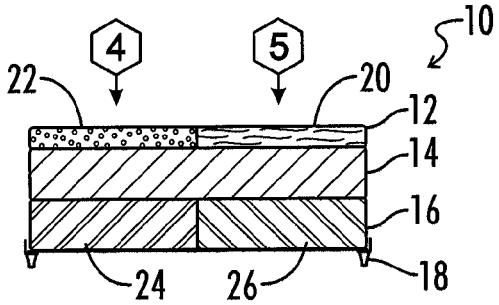
FIG. 4 is a schematic drawing of a cross-sectional view of the embodiment of the sleep system show in FIG. 3 with the comfort layer flipped, or rotated, so that the firmness sections therein are in a reverse configuration. Such reconfiguration results in firmness levels four and five.
Figure 5A:
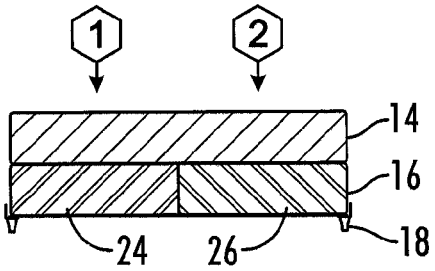
FIG. 5A is a schematic drawing of a cross-sectional view of the embodiment of the present invention shown in FIG. 6, the embodiment having a single foundation layer with two firmness sections. The cross-section is along the 5A-5A line shown in FIG. 6.
Figure 5B:
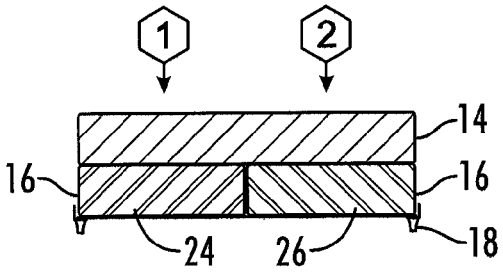
FIG. 5B is a schematic drawing of a cross-sectional view of an embodiment having two separate foundation layers which are placed side by side, so that each foundation layer provides a firmness section as shown therein. The cross-section is along the 5B-5B line shown in FIG. 6.

Shown in FIGS. 3, 4, 5A and 5B are cross sectional views of alternate configurations of the three layers within the system. The cross-sections, or slices, which result in the views shown in FIGS. 3 and 4 are along the 3-3 and 4-4 lines shown in FIG. 7. The cross-section which results in the views shown in FIGS. 5A and 5B are along the 5A-5A line and 5B-5B line, respectively, shown in FIG. 6. The hatching shown in FIGS. 3-5B represents various materials of construction, which are described in detail below. The purpose of the hatching is to show that each firmness section is constructed of a different material. Thus, resulting in the different firmness levels. As further described herein, reorienting or reconfiguring the comfort layer 12 and the foundation layer 16 results in at least six different firmness levels. Those firmness levels are shown in the hexagon shapes in the Figures and are referred to as firmness levels 1-6, with firmness level one being the most firm and firmness level 6 being the most plush. Stated another way, beneath each hexagon shape is a portion of the system 10 including a foundation layer 16, support layer 14 and comfort layer 12 which result in the firmness level indicated. As further described below, firmness levels 1 and 2 result from a foundation layer 16 and support layer 14, without a comfort layer 12. Accordingly, a single system 10, having a foundation layer 16, support layer 14, and comfort layer 12 may be oriented or configured to provide the six firmness levels described herein. Even more alternate firmness levels may be accomplished by substituting into a system 10 a layer made of different materials of construction than the layer which it replaces.

Referring now to FIG. 3, there is shown a cross sectional view of the system 10. Regarding the comfort layer 12, the first firmness section 20 is firm. The second firmness section 22 of the comfort layer 12 is plush, or soft. The support layer 14 has a consistent firmness such that multiple levels of firmness are not available within the support layer 14. With reference to the foundation layer 16, the first firmness section 24 is firm and the second firmness section 26 is plush. As known to one of ordinary skill in the art, the relative firmness of the comfort layer 12 and the foundation layer 16 differ due to the function of each within the system 10. Discussion of materials of construction of each layer is provided below. In the orientation shown in FIG. 3, firmness level six, the most plush, or soft, is achieved by the combination of the second firmness section 22 of the comfort layer 12, the support layer 14, and the second firmness section 26 of the foundation layer 16. Also shown in FIG. 3 is the resulting firmness level three, due to the combination of the first firmness section 20 of the comfort layer and the first firmness section 24 of the foundation layer 16, both of which are firm. In still other embodiments of the present invention, the first firmness section 24 and the second firmness section 26 of the foundation layer 16 may result from the use of separate foundation units which are placed side by side on a bed frame, as further described in relation to FIG. 5B. In such a configuration, the ability to adjust firmness is still present.

Referring now to FIG. 4, there is shown a cross sectional view of the system 10, which has been reconfigured by rotating or flipping the comfort layer 12. As compared to FIG. 3, the orientation of the comfort layer 12 has been changed such that the location of the first firmness section 20 of the comfort layer 12 has been reversed with the second firmness section 22 of the comfort layer 12. Firmness level four results from the combination of the first firmness section 24 of the foundation layer 16 and the second firmness section 22 of the comfort layer 12. Also shown is resulting firmness level five, due to the combination of the second firmness section 26 of the foundation layer 16 and the first firmness section 20 of the comfort layer 12.

Referring now to FIG. 5A, there is shown an embodiment of the system 10 having a foundation layer 16 having two firmness sections. In an alternate embodiment shown in FIG. 5B is a system 10 having two separate foundation layers 16, each having a different firmness, being placed side by side. Each embodiment shown includes the support layer 14. The comfort layer 12 has been removed from each embodiment of the system 10. In the embodiment shown in FIG. 5A, firmness level one, the most firm level, results from the support layer 14 in combination with the first firmness section 24 of the foundation layer 16. Firmness level two results from the combination of the support layer 14 and the second firmness section 26 of the foundation layer 16. In the embodiment shown in FIG. 5B, firmness level one, the most firm level, results from the support layer 14 in combination with the first foundation layer 16 providing firmness section 24. Firmness level two results from the combination of the support layer 14 and the second foundation layer 16 providing firmness section 26.

Figure 6:
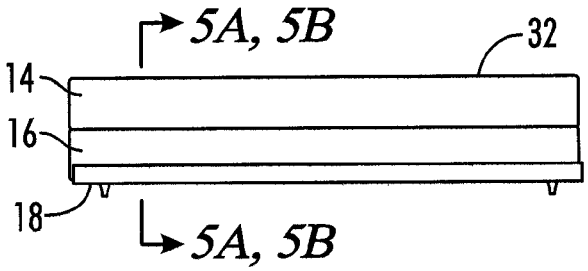
FIG. 6 is a side view of an embodiment of the present invention. This Figure shows the exposed sleeping surface of the support layer of the sleep system.

Referring now to FIG. 6, there is shown an embodiment of the present invention in which the comfort layer 12 has been removed from the system 10. The support layer 14 has a first side 32. The first side 32 of the support layer 14 is constructed of upholstered material such that a sleeping surface is provided. Accordingly, when the comfort layer 12 is removed from the system 10, the first side 32 is exposed and may be used as a comfortable sleeping surface.

Figure 7:
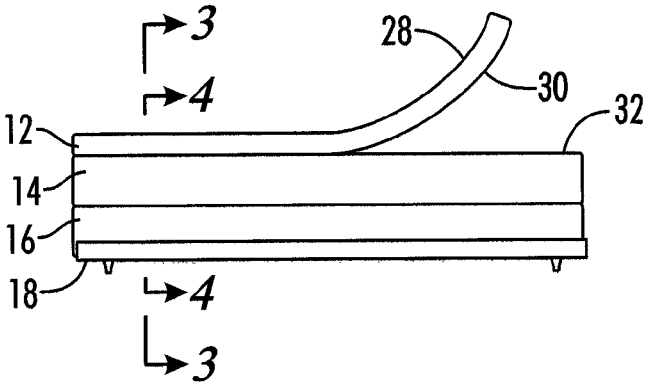
FIG. 7 is a side view of an embodiment of the present invention. Shown therein is the comfort layer bent in an upward position in order to show the first side and second side, both of which are upholstered to provide a comfortable sleeping surface.

Referring now to FIG. 7, there is shown the system 10 in which the comfort layer 12 is bent upward away from the support layer 14 in order to show its flexibility and the first side 28 and the second side 30. The comfort layer 12 is constructed so that both the first side 28 and the second side 30 are sleeping surfaces. To be clear, the comfort layer 12 may be flipped, or rotated, such that either the first side 28 or the second side 30 is facing upward and used for sleeping.

Each of the comfort layer 12, support layer 14, or foundation layer 16 may be selected from a plurality of available firmnesses or mixture of firmnesses. Any of the following examples of each layer may be positioned so that the support layer 14 is on top of the foundation layer 16 and the comfort layer 12 is on top of the support layer 14, in order to provide a system 10, as described herein. In certain embodiments, the system 10 may have the dimensions as known to those of ordinary skill in the art, for example, a single bed, double, queen, king, and the like. In certain embodiments of the present invention, the foundation layer 16 and comfort layer 12 may not have multiple firmness sections on the longitudinal halves of the system 10 for twin size systems 10, although alternate firmness section positioning, as described above, may apply. That is, in a narrow twin size unit, having multiple firmness sections as shown in FIG. 2 may not be desirable.

Regarding the invention disclosed herein, each system 10 includes only one of each layer, and the composition of each layer may be selected from abundant choices. Disclosed below are exemplary materials of construction and embodiments of the present invention. Such disclosure allows one of ordinary skill in the art to make the present invention. In certain embodiments of the present invention, the foundation layer 16 may be constructed of material well known to those of ordinary skill in the art, including, wood, steel wire grids, steel coils, polyurethane foam, or the like, and/or any combination thereof. In certain embodiments of the present invention, the foundation layer 16 may consist of two separate units which are placed side by side, as best seen in FIG. 5B.

Accordingly, each foundation layer 16 unit is constructed of certain materials in order to provide a certain firmness. In such an embodiment, each foundation layer 16 unit acts like a either a first firmness section 24 or a second firmness section 26. In still other embodiments of the present invention, as best seen in FIG. 5A, the foundation layer 16 may be constructed as a single unit having a first firmness section 24 and a second firmness section 26. By way of example, in a certain embodiment, a foundation layer 16 may have a first firmness section 24 that is constructed of wood and a second firmness section 26 that is constructed of wood and a steel wire grid. In another embodiment, the foundation layer 16 may, for example, have a first firmness section 24 that is constructed of steel coil springs and a second firmness section 26 that is constructed of wood, a steel wire grid, and padding. Many combinations of materials known to those of ordinary skill in the art may be used. To be clear, any of the materials of construction may be mixed and matched to obtain a foundation layer 16 having a firmness section, or multiple firmness sections, so that each firmness section has the specifically desired firmness. The foundation layer 16 is then encased within an upholstered covering as known to those of ordinary skill in the art. Those of ordinary skill in the art are familiar with the manner of gluing, sewing, or otherwise attaching the various materials in order to construct a unitary foundation layer 16. Those of ordinary skill in the art are also familiar with the manner of constructing each of the various layers of the system 10 disclosed herein. By way of background, U.S. Patents and U.S. Patent application Publications for various beds include U.S. Patent Application Publication No. 2007/0283501 A1 published on Dec. 13, 2007 by Mossbeck; U.S. Pat. No. 7,386,903 issued to Hochschild on Jun. 17, 2008; U.S. Pat. No. 7,661,166 issued to Marling et al. on Feb. 16, 2010; U.S. Pat. No. 7,454,810 issued to Wells on Nov. 25, 2008; U.S. Pat. No. 6,101,653 issued to England on Aug. 15, 2000; U.S. Pat. No. 4,213,214 issued to Gilhooly on Jul. 22, 1980; U.S. Pat. No. 3,534,417 issued to Boyles on Oct. 20, 1970; U.S. Pat. No. 2,651,788 issued to Forwood on Sep. 15, 1953, and U.S. Pat. No. 5,819,349 issued to Schwartz on Oct. 13, 1998, each of which is hereby incorporated by reference in its entirety. As stated herein, the materials of construction described are readily commercially available and well known in the bedding industry. Also, manufacturers are readily available for the manufacture of such bedding goods, according to the known methods of manufacture within the bedding industry.

In certain embodiments of the present invention, the foundation layer 16 may have a height of from about 4 inches to about 12 inches, and is preferably 8-10 inches high. The foundation layer 16 is not intended to provide a sleeping surface. Accordingly, such additional padding or preferred fabric associated with a sleeping surface is not present. While only limited examples of the construction of the foundation layer 16 have been described herein, those of ordinary skill in the art will appreciate the large number of differing adjustments which may be made to the disclosure provided herein.

In certain embodiments of the present invention, the support layer 14 may be constructed of material similar to those used in a conventional mattress. Such materials generally including steel inner springs, polyurethane foam, wool, cotton, latex foam, memory foam, and the like, and/or any combination thereof. In certain embodiments, the support layer 14 may include air chambers, bladders, or the like. Such materials are well known in the bedding industry and readily commercially available. The support layer 14 has a consistent firmness, or density, and does not have various firmness sections like the foundation layer 16 and the comfort layer 12. The support layer 14 is encased within fabric or other conventional material as known in the bedding industry. The first side 32 of the support layer 14 is provided to be a sleeping surface. Accordingly, the first side 32 is covered in an upholstered material, as known to those of ordinary skill in the art, in order to provide a comfortable sleeping surface. Such upholstered materials are readily commercially available and well known in the bedding industry. Such materials are fixedly secured, as known to those of ordinary skill in the art, to the support layer 14. In certain embodiments of the present invention, the support layer 14 has a height of from about 9 inches to about 16 inches. In still other embodiments, the support layer 14 has a height of from about 9 inches to about 12 inches.

In certain embodiments of the present invention, the comfort layer 12 may be constructed of material well known in the bedding industry and readily commercially available, such as gel, latex foam, memory foam, micro-coils, polyurethane foam, and the like, and/or any combination thereof. In certain embodiments of the present invention, the comfort layer 12 may, for example, have a first firmness section 20 constructed of memory foam and a second firmness section 22 constructed of latex. In other embodiments, the comfort layer 12 may, for example, have a first firmness section 20 constructed of latex foam and a second firmness section 22 constructed of a mixture of latex foam and memory foam. In still other embodiments, the comfort layer 12 may, for example, have a first firmness section 20 constructed of gel and a second firmness section 22 constructed of latex foam. To be clear, any of the materials of construction may be mixed and matched to obtain a comfort layer 12 having a firmness section, or multiple firmness sections, so that each firmness section has the specifically desired firmness. Those of ordinary skill in the art are familiar with gluing, sewing, or otherwise fixedly securing the first firmness section 20 to the second firmness section 22 of the comfort layer 12. Both the first side 28 and the second side 30 of the comfort layer 12 are covered with an upholstered material, or other sleeping surface fabric, so that a user may sleep on either side. As previously stated herein, such materials are readily commercially available and well known in the bedding industry. In certain embodiments of the present invention, the comfort layer 12 may have a height of from about 3 inches to about 7 inches. In alternate embodiments, the comfort layer 12 may have a height of from about 4 inches to about 6 inches.

The sleeping system 10 is easily reconfigured by a person. One manner of reconfiguring the system 10 is to remove the comfort layer 12. Another manner of reconfiguring the system 10 is to rotate, or flip, the comfort layer 12, in order to reverse the positions of the firmness sections therein. Also, a person may rotate (not flip) the foundation layer 16. That said, in practical terms, rotating the foundation layer 16 is really just repositioning the system 10 so that the head of the bed is swapped with the foot of the bed. In alternate embodiments having side by side foundation layer 16 units, a person may reverse the positioning of the side by side foundation layer 16 units. The wide range of adjustable bedding which is provided by the present invention has been described herein. Any of the many foundation layers 16 may be combined with any of the many comfort layers 12 in order to build a bed which provides the desired firmness. Additionally, in certain embodiments, varieties of materials of construction for the support layer 14 allow for selection of a support layer 14 to compliment the foundation layer 16 and comfort layer 12.

The method of selling the present system 10 provides the benefit that only a limited number of display systems 10 are needed on retail floor space, rather than a large number of individual beds, each of which offers a different firmness.

Because the comfort layer 12 may be easily rotated, flipped, or removed by a single person, all six of the firmness levels of a system 10 may be shown to, and experienced by, a consumer with the use of only a single display system 10. Further, many comfort layers 12 having alternate firmnesses may be stored near the system 10 for easy substitution with the system 10. The only reason there would be a need for multiple display systems 10 would be display alternate foundation layers 16. Given the larger size of the foundation layer 16, and the necessity to remove the support layer 14 therefrom, it may be less practical for a retailer to provide such reconfiguration while attempting to make a sale. Requiring drastically less retail floor space while still offering the opportunity to test multiple firmness levels is a benefit to the retailer such that the store size may be smaller. Alternatively, a retailer may use the remaining floor space to display other goods for sale.

The current system 10 also provides the opportunity to offer different price points of bedding depending on the configuration of the system 10 sold. In certain embodiments of the present intention, a retailer may offer a system 10 at a reduced price point merely by not including the comfort layer 12 in the sale. In alternate embodiments, the retailer may offer bedding at a higher price point by including the comfort layer 12.

After selling the present system 10, continued alteration of the firmness of the sleeping system 10 may be provided by exchanging the comfort layer 12. In certain embodiments of the present invention, a retailer, or wholesaler, that sold a system 10 may exchange, or replace, the comfort layer 12 of the system 10 without having to replace the remainder of the system 10. In the bedding industry, when a bed is sold, it is the property of the consumer without the opportunity for exchange of any of the parts thereof. In the present invention, the party selling the system 10, generally a retailer or wholesaler, may exchange the comfort layer 12 by mail, or shipping. Those of ordinary skill in the art are familiar with the many types of mailing or shipping which would be appropriate to provide timely transport of comfort layers 12 as described herein. For example, at a point in the future, a retailer may provide a previous consumer an alternate firmness experience by providing the latest comfort layer 12 for use in combination with the consumer's system 10, which may have been purchased years before. This method of exchanging component parts may be applied to other bedding as well.

This patent application expressly incorporates by reference all patents, references, and publications disclosed herein.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A sleeping system, comprising:

a comfort layer of unitary construction with a length and a width;

a support layer of unitary construction with a length and a width positioned beneath and independent of the comfort layer;

a foundation layer with a length and a width positioned beneath and independent of the support layer;

wherein the comfort layer comprises a first firmness section and a second firmness section dividing the comfort layer into two sections along its length, each section of the comfort layer having a different firmness level;

wherein the foundation layer comprises a first firmness section and second firmness section dividing the foundation layer into two sections along its length, each section of the foundation layer having a different firmness level;

wherein the sleeping system provides six different firmness levels achieved by changing the stacking configuration of the layers, said firmness levels comprising:

a first firmness level and a second firmness level achieved by positioning the foundation layer beneath the support layer beneath the comfort layer, wherein the first firmness section of the comfort layer is positioned above the first firmness section of the foundation layer, and the second firmness section of the comfort layer is positioned above the second firmness section of the foundation layer, wherein the comfort layer forms the topmost layer;

a third firmness level and a fourth firmness level achieved by positioning the foundation layer beneath the support layer beneath the comfort layer, wherein the first firmness section of the comfort layer is positioned above the second firmness section of the foundation layer, and the second firmness section of the comfort layer is positioned above the first firmness section of the foundation layer, wherein the comfort layer forms the topmost layer;

a fifth firmness level and a sixth firmness level achieved by positioning the foundation layer beneath the support layer.

2. The system of claim 1, wherein the comfort layer has a first side and a second side, the first side of the comfort layer having a sleeping surface and the second side of the comfort layer having a sleeping surface.

3. The system of claim 1, wherein the foundation layer has a plurality of firmness sections.

4. A bedding system, comprising:

a support layer of uniform firmness, the support layer having a sleeping surface;

a foundation layer of unitary construction positioned beneath and in contact with the support layer;

wherein the foundation layer has a first firmness section and second firmness section attached to each other contiguously, so that the bedding system has a plurality of firmness levels.

5. The system of claim 4, wherein the first firmness section of the foundation layer is more firm that the second firmness section of the foundation layer.

6. The system of claim 5, wherein a portion of the system having the first firmness section of the foundation layer has a first of the plurality of firmness levels.

7. The system of claim 6, wherein a portion of the system having the second firmness section of the foundation layer, has a second of the plurality of firmness levels.

8. The system of claim 7, further comprising a comfort layer positioned on top of the support layer, the comfort layer having a first side and a second side, wherein the comfort layer is customizable to a desired firmness.

9. The system of claim 8, wherein the first side of the comfort layer is a sleeping surface and the second side of the comfort layer is a sleeping surface.

10. The system of claim 9, wherein the comfort layer is rotatable.

11. The system of claim 10, wherein the comfort layer is able to be flipped.

12. The system of claim 9, wherein the comfort layer has a first firmness section and a second firmness section.

13. The system of claim 12, wherein the first firmness section of the comfort layer is more firm than the second firmness section of the comfort layer.

14. The system of claim 13, wherein the portion of the system having orientation of the first firmness section of the comfort layer above the first firmness section of the foundation layer has a third of the plurality of firmness levels.

15. The system of claim 13, wherein the portion of the system having orientation of the second firmness section of the comfort layer above the first firmness section of the foundation layer has a fourth of the plurality of firmness levels.

16. The system of claim 13, wherein the portion of the system having orientation of the first firmness section of the comfort layer above the second firmness section of the foundation layer has a fifth of the plurality of firmness levels.

17. The system of claim 13, wherein the portion of the system having orientation of the second firmness section of the comfort layer above the second firmness section of the foundation layer has a sixth of the plurality of firmness levels.

* * * * *